United States Patent [19]

Natsume

[11] Patent Number: 4,712,933

[45] Date of Patent: Dec. 15, 1987

[54] RIBBON GUIDE DEVICE INCLUDING A SEPARATE, LONGITUDINALLY SHIFTABLE, RIBBON GUIDE MEMBER

[75] Inventor: Yukihito Natsume, Nagoya, Japan

[73] Assignee: Brother Kogyo Kabushiki Kaisha, Japan

[21] Appl. No.: 940,177

[22] Filed: Dec. 10, 1986

Related U.S. Application Data

[63] Continuation of Ser. No. 739,379, May 30, 1985, abandoned.

[30] Foreign Application Priority Data

Jun. 1, 1984 [JP] Japan ..... 59-82243[U]

[51] Int. Cl.[4] ..... B41J 35/04

[52] U.S. Cl. ..... 400/248; 400/208; 400/233

[58] Field of Search ..... 400/120, 194, 195, 196, 400/196.1, 207, 208, 208.1, 233, 248, 250

[56] References Cited

U.S. PATENT DOCUMENTS

| | | | |
|---|---|---|---|
| 4,203,676 | 5/1980 | Hatsell | 400/208 |
| 4,350,452 | 9/1982 | Dials et al. | 400/208 |
| 4,352,575 | 10/1982 | Shore | 400/208 X |
| 4,352,577 | 10/1982 | Chida et al. | 400/196.1 |
| 4,437,778 | 3/1984 | Miyashita et al. | 400/208 |
| 4,507,668 | 3/1985 | Horiya et al. | 400/120 X |
| 4,511,903 | 4/1985 | Miyazaki et al. | 400/208 X |
| 4,600,325 | 7/1986 | Okamoto et al. | 400/208 |

FOREIGN PATENT DOCUMENTS

| | | | |
|---|---|---|---|
| 0019649 | 12/1980 | European Pat. Off. | 400/208.1 |
| 3138110 | 4/1983 | Fed. Rep. of Germany | 400/196 |
| 3346482 | 7/1984 | Fed. Rep. of Germany | 400/240.3 |
| 0072111 | 5/1979 | Japan | 400/196.1 |
| 0142688 | 11/1980 | Japan | 400/196.1 |
| 0013193 | 2/1981 | Japan | 400/196 |
| 0057954 | 4/1982 | Japan | 400/196.1 |
| 0074181 | 5/1982 | Japan | 400/208 |
| 0101046 | 6/1982 | Japan | 400/208 |
| 0096976 | 7/1983 | Japan | 400/196.1 |
| 0217384 | 12/1983 | Japan | 400/233 |
| 0009083 | 1/1984 | Japan | 400/120 |

OTHER PUBLICATIONS

IBM Technical Disclosure Bulletin, "Ribbon Attachment", Heidt et al, vol. 1, No. 6, Apr. 1959; pp. 43–44.

Webster's New Collegiate Dictionary, p. 10, copyright 1961 by G&C Merriam Co., Publishers, Springfield, Mass.

American Heritage Dictionary, New College Edition, p. 199, copyright 1976 by Houghton Mifflin Co., Publishers, One Beacon Street, Boston, Mass. 02107.

*Primary Examiner*—Ernest T. Wright, Jr.

*Attorney, Agent, or Firm*—Bierman and Muserlian

[57] ABSTRACT

When a ribbon cassette containing a print ribbon and having a looped portion exposed to the outside is mounted on a printer frame, a ribbon guide member movable along a print line of a platen, while in its initial position, is located within a region surrounded by the looped ribbon portion. The ribbon guide member is moved as a carriage mounted with a print head travels. While in engagement with the looped ribbon portion, the ribbon guide member moves to a position beyond one end of a printing range, where it is releasably latched. Thus, the ribbon is automatically stretched to cover the whole printing range.

11 Claims, 7 Drawing Figures

RIBBON GUIDE DEVICE INCLUDING A SEPARATE, LONGITUDINALLY SHIFTABLE, RIBBON GUIDE MEMBER

This application is a continuation of application Ser. No. 739,379, filed May 30, 1985, now abandoned; which claims the priority of Japanese application No. 59/82243, filed June 1, 1984.

BACKGROUND OF THE INVENTION

The present invention relates to printers, such as serial-type line printers, word processors, typewriters, etc., which are provided with a print element, e.g., a matrix-type print head, traveling along a print line of a platen, and execute a printing operation by means of a print ribbon stretched along the print line.

The printers of this type are generally constructed so that a ribbon cassette or cartridge as a ribbon supply means containing a print ribbon is mounted on a printer frame, the ribbon is partially exposed from the cassette to the outside, and the exposed ribbon portion is stretched so as to cover the whole printing range or stroke of a print element along a print line.

These prior art printers are disclosed in, for example, U.S. Pat. Nos. 4,203,676 and 4,352,575 and Japanese Utility Model Disclosures Nos. 54-72111, 57-101046, 57-57954 and 58-96976.

As means for stretching the print ribbon over the whole printing range, a mechanism is shown in, e.g., FIG. 8 of the Japanese Utility Model Disclosure No. 57-101046 which is designed so that a looped ribbon portion exposed to the outside is passed around a ribbon guide member which is provided with a guide roller mounted on the frame. In this case, the ribbon cassette is located in a fixed position on one end side of the printing range, while the ribbon guide member is positioned beyond the other end of the printing range. After mounting the cassette on the frame, the operator manually draws out the exposed ribbon portion and passes it around the ribbon guide member, thereby stretching the ribbon in place.

With the above described arrangement, however, the ribbon stretching work requires a very troublesome manual operation, inevitably soiling the operator's hands. Also, the exposed ribbon portion must be drawn out considerably long by manual operation. Unless the ribbon is carefully handled while it is being stretched, therefore, it may possibly be twisted or wrinkled, constituting a hindrance to ribbon feed during printing.

Disclosed in the Japanese Utility Model Disclosures Nos. 54-72111, 57-57954 and 58-96976, on the other hand, are printers in which the ribbon cassette is long from side to side so that the ribbon portion stretched between two ribbon exposing ends at both sides of the cassette can cover the printing range as it is.

In this arrangement, however, the cassette is increased in size, requiring a wider mounting space and limiting the spaces for other components of the printer. This is undesirable in view of the printer design, especially of the miniaturization of the printer.

As shown in FIGS. 3 to 6 of the Japanese Utility Model Disclosure No. 57-101046, for example, the printer may be provided with an arm member which can be slidably or pivotally drawn out from a compact cassette, and which is adapted to be extended so that the ribbon is stretched long when the cassette is set in place. Disclosed in the U.S. Pat. No. 4,203,676, moreover, is a printer in which the ribbon is arranged along the platen by means of a pair of flexible leaders and bridge means connecting the same. In the former arrangement, however, the cassette is complicated in construction, while in the latter the construction of the ribbon guide member is complicated, increasing the manufacturing cost. Likewise, in a printer disclosed in the U.S. Pat. No. 4,352,575, the cartridge is provided with a slidable adapter and is therefore complicated in construction, leading to an increase in cost.

Among the conventional examples described above, in particular, those printers using cassettes or cartridges of a special construction are undesirable. The reason is that, being disposable goods, the cassettes or cartridges for printers will be uneconomical and unfit for practical use if they are increased in unit cost due to their special construction.

SUMMARY OF THE INVENTION

The object of the present invention is to provide a printer in which a print ribbon can be automatically quickly stretched in place without requiring any operator's manual operation, thus obviating the possibility of its soiling the operator's hand or being twisted or wrinkled, and which is simple in construction, reduced in cost, and easy to miniaturize.

In order to achieve the above object, a printer according to the present invention is basically constructed so that a print ribbon partially exposed from a ribbon supply means is caused to engage a ribbon guide member movable along a print line on a platen, and the ribbon guide member is moved to a predetermined position, where it is releasably latched. Thus, the ribbon is stretched along the print line between the ribbon supply means and the ribbon guide member.

The predetermined position in which the ribbon guide member is latched is located in a position beyond one end of the printing range of the printing means, and the ribbon supply means is located in a position corresponding to the other end of the printing range. As a result, the ribbon can be stretched so as to cover the whole printing range.

In a preferred arrangement of the printer according to the invention, the ribbon guide member is slidably supported on a guide shaft which also supports a carriage mounted with a print head. The guide shaft extends parallel to the platen, and the carriage travels on the shaft with the progress of printing operation. In an initial state or setup state for the start of printing, the ribbon guide member is located within a region surrounded by a looped ribbon portion exposed from a ribbon cassette. As the carriage travels, the ribbon guide member is moved together therewith to be set in place. Thus, the ribbon is automatically stretched without troubling the operator.

The printer is also provided with a control device for detecting the positions of the ribbon guide member, carriage, and ribbon cassette and controlling the movement of the ribbon guide member in response to the detection, whereby a series of operating steps for initialization of the printer, i.e., for setting the printer to a setup or initial state for printing is executed. Accordingly, the ribbon stretching operation can be quickly performed with ease.

Thus, according to the present invention, the operator need not directly touch the ribbon to soil his hands therewith. Moreover, since the ribbon guide member moves in a straight line while in engagement with the ribbon, the ribbon can be smoothly drawn out from the ribbon supply means without being twisted or wrinkled.

According to the present invention, furthermore, a small-sized cassette can be used for the ribbon supply means, requiring only simple construction, which leads to miniaturization of the printer and a reduction in manufacturing cost.

BRIEF DESCRIPTION OF THE DRAWINGS

These and other objects and advantages of the present invention will be more completely described below with reference to the accompanying drawings, in which.

A preferred embodiment of the present invention will now be described in detail with reference to the accompanying drawings.

DETAILED DESCRIPTION OF THE PREFERRED EMBODIMENT

Figure 1:
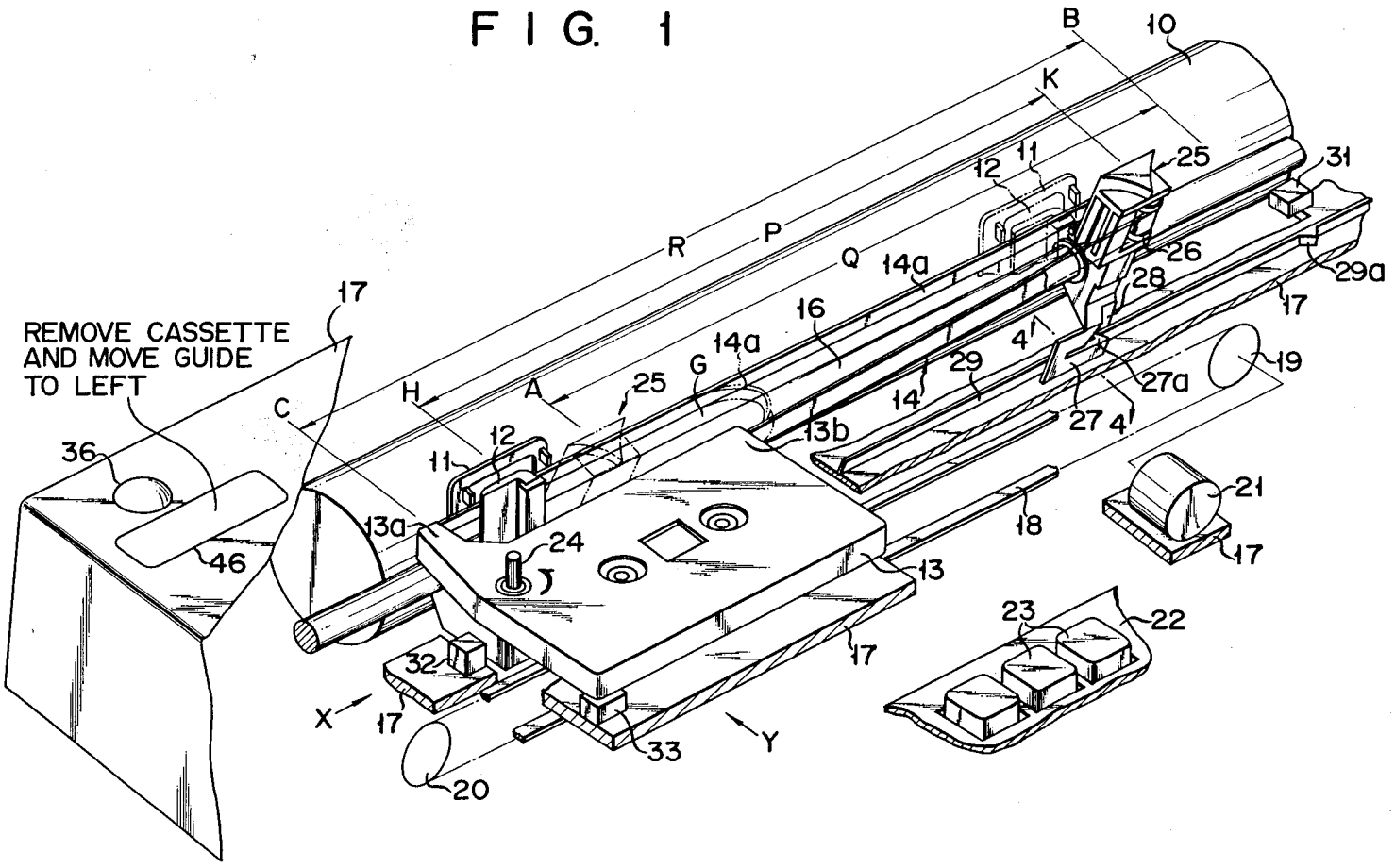
FIG. 1 is a cutaway perspective view schematically showing a printer according to the present invention loaded with a ribbon cassette.
Figure 2:
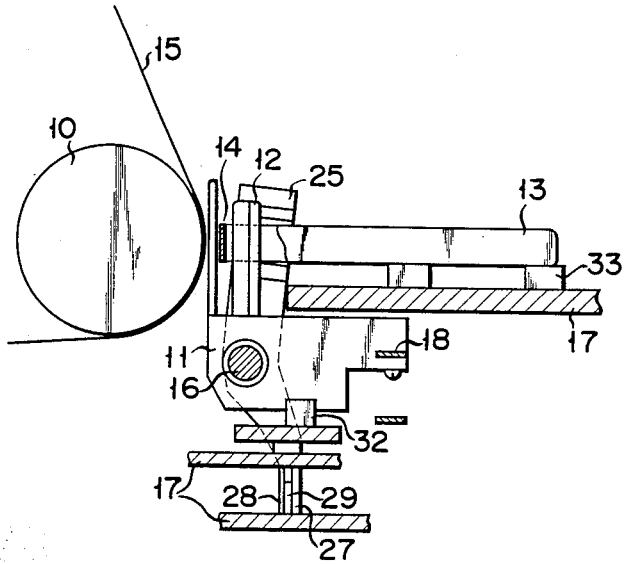
FIG. 2 is a schematic view of the printer of FIG. 1 taken in the direction indicated by arrow X.
Figure 3:
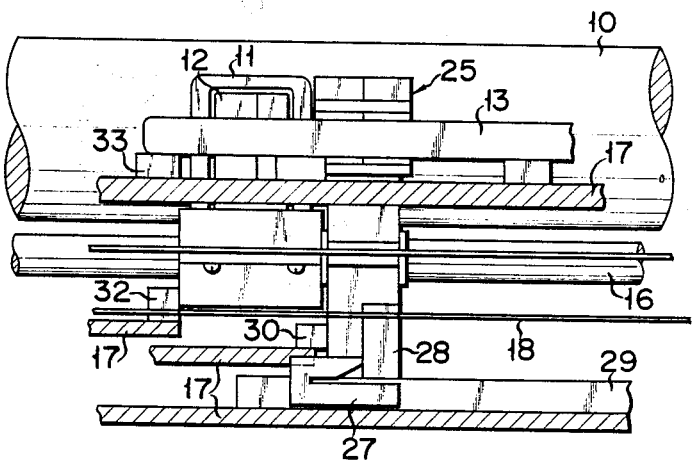
FIG. 3 is a schematic view of the printer of FIG. 1 taken in the direction indicated by arrow Y.

Referring now to FIGS. 1 to 3, there is shown a printer which comprises a rotatable platen 10, a carriage 11 capable of reciprocating along a print line formed along the longitudinal direction of the platen 10, a thermal-type print head 12 as a print element mounted on the carriage 11, a ribbon cassette 13 containing ribbon supply means, and a print ribbon 14 of a thermal transfer type contained in the cassette 13 and including a looped portion 14*a* exposed from the cassette 13 to the outside. In the printing operation, the carriage 11 travels along the print line, and the print head 12 on the carriage 11 transfers ink on the ribbon 14 to a sheet of printing paper 15 (FIG. 2) on the platen 10 by a thermal transfer process. On completion of printing for each line, the carriage 11 returns to a home position H as shown in FIG. 1, where printing for the next line is started. Thus, the printer of this embodiment is a so-called serial type line printer.

The carriage 11 can move from the home position H to an extreme right end position K, so that the maximum printable length of the print head 12 along the print line, i.e., printing range, is equal to the distance P between the positions H and K. Namely, the position H is one end position of the printing range, and K the other. In this embodiment, the home position at which the carriage 11 is normally stopped is adjusted to the one end position H. It may, however, be set in any position in the middle of the printing range.

A guide shaft 16 extends parallel to the platen 10, having its both ends (not shown) fixedly supported on a printer frame 17. The carriage 11 is slidably fitted on the guide shaft 16. The movement of the carriage 11 on the guide shaft 16 is accomplished by a reversible carriage drive motor 21 mounted on the frame 17 with the aid of an endless drive belt 18 fixed to the carriage 11 and a pair of pulleys 19 and 20 supporting the belt 18.

Printing operation or operation for some other prescribed function is performed by depressing keys 23 in a keyboard 22 of the printer.

The ribbon cassette 13 is rectangular in shape and has ribbon exposing ends 13*a* and 13*b*. The one exposing end 13*a* is in the form of an arm extending toward the platen 10 and located so that the ribbon 14 coming out of the end 13*a* is interposed just between the platen 10 and the print head 12.

Thus, the one exposing end 13*a* is located closer to the platen 10 than the other exposing end 13*b*, so that the exposed ribbon portion 14*a* forms a loop between the exposing ends 13*a* and 13*b* although it is in a normal state without being drawn out long, defining a region G surrounded thereby, as outlined by chain line in FIG. 1.

The cassette 13 is removably mounted on the frame 17 in a fixed position corresponding to the home position H of the carriage 11. The internal structure of the cassette 13 containing the ribbon 14 may be of a conventional arrangement, and its detailed description is therefore omitted herein.

In FIG. 1, numeral 24 designates a manual control knob for rewinding the ribbon 14. The exposed ribbon portion 14*a* can be taken up by turning the knob 24 in the direction indicated by an arrow in FIG. 1.

Also, the mechanism for feeding the ribbon 14 in accordance with the printing operation may be conventional and is not illustrated.

A ribbon guide member 25, which is slidably fitted on the guide shaft 16, includes a ribbon guide roller 26 and a pair of resilient pieces 27 and 28 at the lower end portion forming resilient means.

A guide rail 29, which is elastically held between the two resilient pieces 27 and 28, is mounted on the frame 17, extending parallel to the platen 10 along the print line. The resilient pieces 27 and 28 are lightly in frictional contact with the guide rail 29 without excessively resisting against the movement of the ribbon guide member 25. The resilient pieces 27 and 28 still prevent the member 25 from rotating around the guide shaft 16.

A projection 27*a* is integrally formed on that surface of the one resilient piece 27 which faces the guide rail 29. On the other hand, a mating projection 29*a* is formed on that surface of the guide rail 29 facing the resilient piece 27.

The ribbon guide member 25 can move within a transfer range Q between a first position or initial position A indicated by chain line and a predetermined second position or moved position B beyond the end portion K of the printing range P. In the position A, which adjoins the carriage 11 and the print head 12 in the home position H, the ribbon guide member 25 is located within the region G of the normally looped ribbon portion 14*a*.

Figure 4:
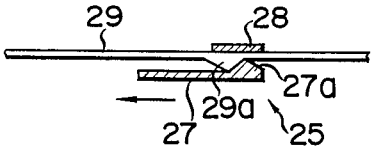
FIG. 4 is a sectional view of the principal part of the printer taken along line 4—4 of FIG. 1.

In the position B, the relative positions of the guide rail 29 and the resilient pieces 27 and 28 are as shown in FIG. 4, in which the projection 27*a* is positioned beyond the mating projection 29*a* and held there by the elastic force of the resilient pieces 27 and 28. The ribbon guide member 25 is therefore releasably latched in this position against a tensile force exerted thereon by the ribbon 14 in the direction indicated by an arrow shown in FIG. 4. If the operator grasps the ribbon guide member 25 and pushes it strongly in the direction indicated by the arrow shown in FIG. 4, the member 25 is released from the latched state. The pair of resilient pieces 27 and 28 and the facing projections 27a and 29a constitute latch means.

When the ribbon guide member 25 reaches the position B with the ribbon portion 14a threaded on the roller 26, as shown in FIG. 1, the ribbon 14 is stretched within a range of length R between the position B and a position C which corresponds to the one ribbon exposing end 13a of the cassette 13.

Since the positions B and C are located on the right of the printing range P beyond the one end K thereof and on the left beyond the other end H, respectively, the ribbon 14 covers the whole printing range P.

The frame 17 carries thereon guide detecting switches 30 and 31 formed of limit switches constituting position detecting means, corresponding to the positions A and B of the ribbon guide member 25, respectively. Also, a carriage detecting switch 32 formed of a limit switch constituting position detecting means is mounted on the frame 17, corresponding to the home position H of the carriage 11. When these positions are reached by their corresponding members, the switches 30, 31, and 32 are turned on and deliver detection signals. Likewise, a cassette detecting switch 33 formed of a limit switch constituting means for detecting the presence of the cassette 13 is mounted on the frame 17. When the cassette 13 is set in place, the switch 33 is turned on and delivers a detection signal.

Instead of being formed of contact-type limit switches, the switches 30 to 33 may be composed of non-contact switches such as optical switches. The switches 30 to 33 serve as components of a control device which will be described in detail later.

Figure 5:
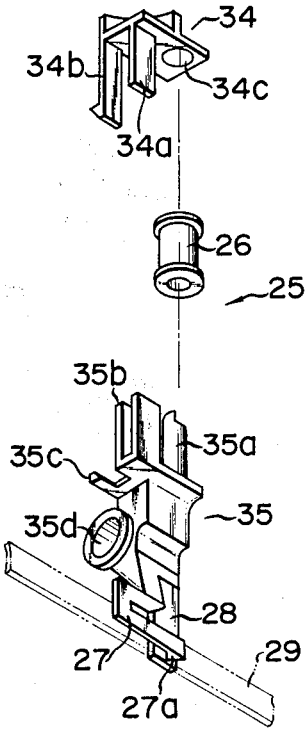
FIG. 5 is an exploded perspective view of a ribbon guide member.

As shown in FIG. 5, the ribbon guide member 25 comprises disjoinably assembled upper and lower plastic brackets 34 and 35 capable of integral molding and the guide roller 26 is rotatably mounted on a support shaft 35a of the lower bracket 35. In an assembled state, a pendent piece 34a of the upper bracket 34 is fitted in a forked rising piece 35b of the lower bracket 35, a hook piece 34b of the upper bracket 34 is retained by a latch piece 35c of the lower bracket 35, and the upper end of the support shaft 35a is fitted in an engaging hole 34c in the upper bracket 34. Thus, the upper and lower brackets 34 and 35 are joined together into an integral body. The lower bracket 35 has an aperture 35d through which the guide shaft 16 is passed.

A display lamp 36 shown in FIG. 1 is located in such a position on the outer surface of the frame 17 that the operator can satisfactorily observe the lamp 36. Thus, the display lamp 36 serves as means for enabling the operator to visually recognize the position of the ribbon guide member 25. Namely, when the ribbon guide member 25 is located in an intermediate position within the transfer range Q (excluding the initial position A and moved position B) with the cassette 13 set in place, the lamp 36 is turned on to inform the operator of the need for the ribbon guide member 25 to be moved to the initial position A.

Although not illustrated in FIGS. 1 to 5, the printer is further provided with power switch 43 for starting the printer, print head drive device 45 for driving the print head 12, and motor drive device 44 for the carriage drive motor 21. The printer is connected to a central processing unit (hereinafter referred to as CPU) 40 of the control device which will be mentioned later.

Figure 6:
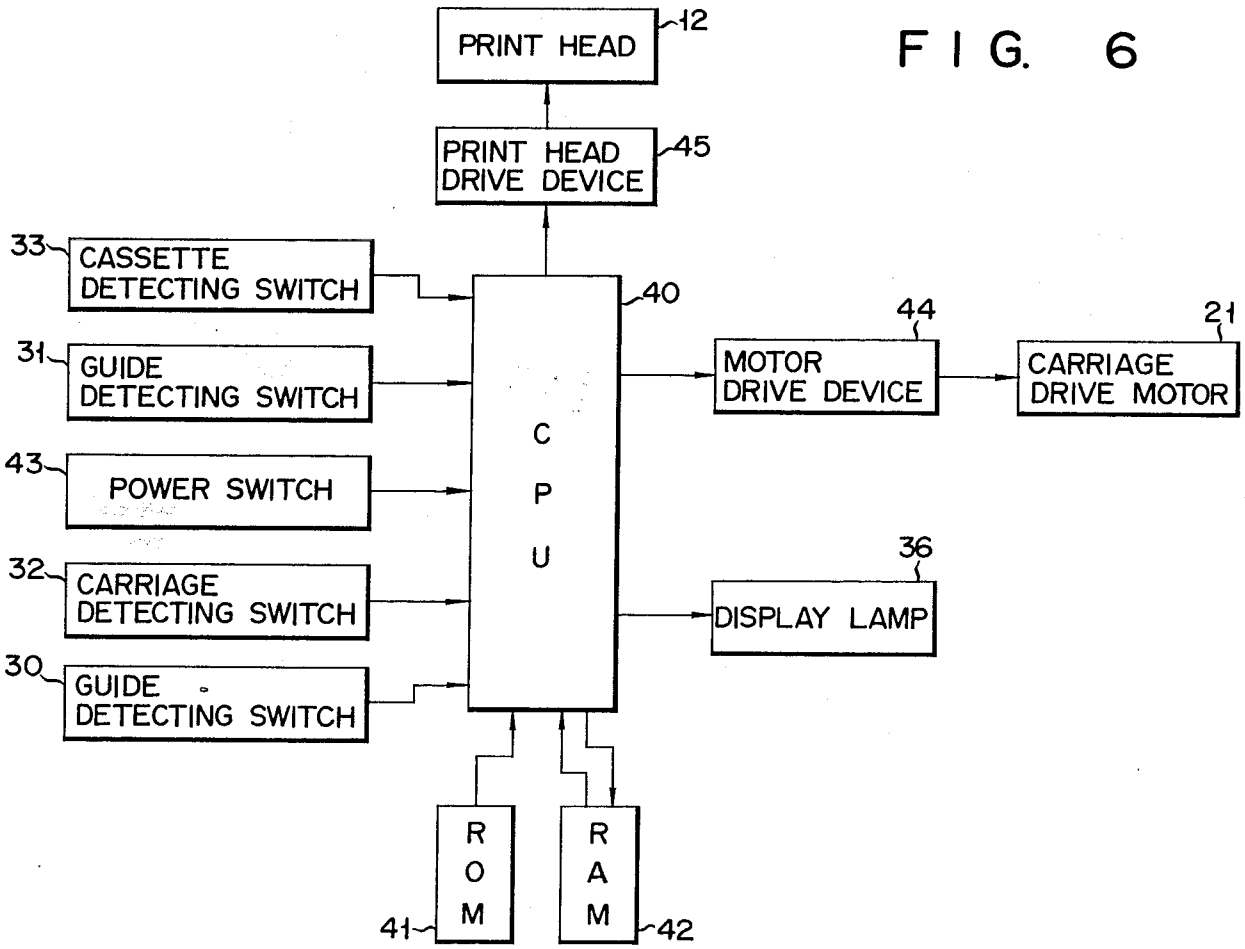
FIG. 6 is a block diagram of a control device of the printer of the invention.

Referring now to the block diagram of FIG. 6, the control device of the printer will be described.

The CPU 40 consisting the principal part of the control device is connected with a read-only memory (hereinafter referred to as ROM) 41 storing a control program for initialization of the printer, i.e., for setting the printer to a setup state for printing, and a random access memory (hereinafter referred to as RAM) 42 in and from which character data, tab data and other data provided in response to the depression of the keys 23 are written and read.

The CPU 40 is also connected with the guide detecting switches 30 and 31, the carriage detecting switch 32, and the cassette detecting switch 33. When switches 32 and 33 are turned on, detection signals are delivered to the CPU 40.

When a main power switch 43 is closed to bring the printer into an initial state or setup state for the start of printing, the CPU 40 checks the detection signals from the detecting switches 30 to 33 for presence. If the detection signals from the cassette detecting switch 33, carriage detecting switch 32, and guide detecting switch 30 are delivered without the output from the guide detecting switch 31, the CPU 40 delivers an actuating signal to the carriage drive motor 21 through the motor drive device 44, thereby starting the motor 21. Then, the carriage 11 is moved from the home position H to the right of FIG. 1. Pushed by the carriage 11, therefore, the ribbon guide member 25 slides on the guide shaft 16 from the initial position A (indicated by chain line) to the right. As a result, the looped ribbon portion 14a engages the guide roller 26 of the ribbon guide member 25 and moves to the moved position B as it is. Thereupon, the switch 31 is turned on to deliver its detection signal to the CPU 40, which in its turn delivers a stop signal to the motor 21, thereby stopping the carriage 11. Thus, the ribbon guide member 25 is latched in the moved position B, and the ribbon 14 is automatically stretched to cover the whole printing range P without requiring the operator's manual operation.

Thereafter, the CPU 40 delivers a reversal signal to the motor 21, thereby restoring the carriage 11 to the home position H. Thus, the preparation for the printing operation, that is, initialization of the printer, is completed.

Subsequently, a print signal is delivered from the CPU 40 to the print head 12 through the print head drive device 45 in response to the depression of the keys 23, so that a desired printing operation is performed.

Referring now to the flow chart of FIG. 7, a series of control operations for the initialization of the printer will be described.

Figure 7:
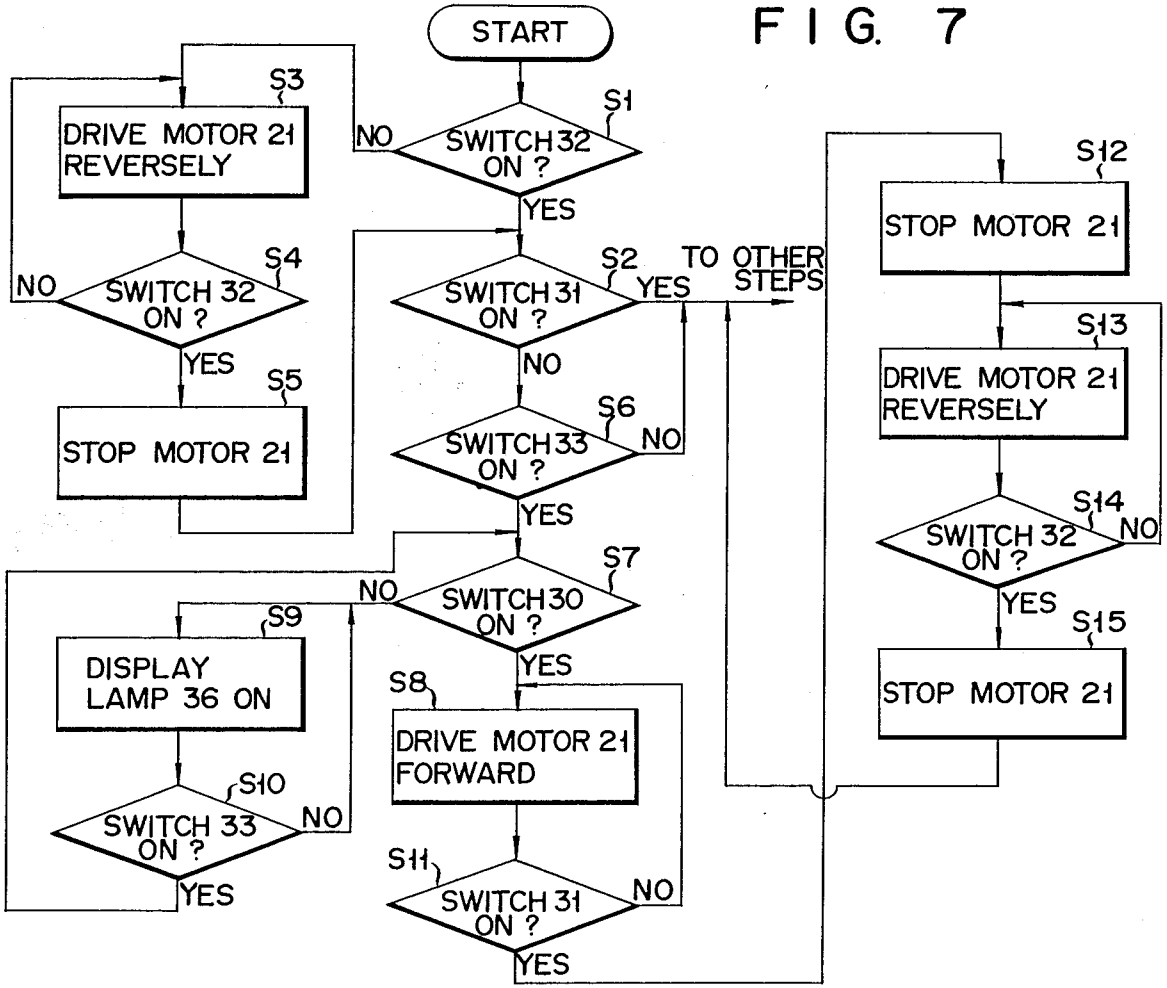
FIG. 7 is a flow chart for illustrating a series of control operations for initialization of the printer according to the invention.

When the CPU 40 detects the activation of the power switch 43, it executes initialization of the printer in accordance with a control program for initialization stored in the ROM 41, that is, in accordance with the flow chart of FIG. 7. First, in step S1, the carriage 11 is checked for location in the home position H. If the carriage 11 is found to be in the home position H, the switch 32 is turned on to give a decision YES, and step S2 is then entered. If the carriage 11 is found to be off the home position H, step S3 is entered in which the motor 21 starts to rotate reversely. Then, in step S4, the carriage 11 is moved toward the home position H, the switch 32 is checked for activation. If the home position H is not yet reached by the carriage 11, the reverse rotation of the motor 21 is continued. When the activation of the switch 32 is detected, step S5 is entered in which the motor 21 is stopped, and step S2 is then entered.

In step S2, the ribbon guide member 25 is checked for location in the moved position B. If it is found to be in the moved position B, then the CPU 40 detects that the switch 31 is turned on, giving a decision YES. In this case, the carriage 11 and the ribbon guide member 25 are located in the home position H and the moved position B, respectively, so that the CPU 40, considering the initialization of the printer to have ended, emerges from the control program for initialization and proceeds to another step, in which it waits for an input instruction signal from the keyboard 22 or external equipment such as a computer. If a decision NO is given in step S2, step S6 is entered in which the cassette 13 is checked for presence. If the cassette 13 is not found to be set in place, that is, if the CPU 40 detects no activation of the switch 33 (NO), the CPU 40, expecting a printing mode using thermosensitive paper as printing paper without the use of the ribbon cassette 13, proceeds to another step for a printing mode based on key operation.

If the cassette 13 is found to be mounted in place in step S6, step S7 is entered in which the ribbon guide member 25 is checked for location in the initial position A. If the ribbon guide member 25 is found to be in the initial position A, that is, if the CPU 40 detects that the switch 30 is on, step S8 is entered in which the motor 21 starts forward rotation to move the carriage 11 toward the end position K. As the carriage 11 moves in this manner, the ribbon guide member 25 moves toward the moved position B, pushed by the carriage 11. The forward rotation of the motor 21 is continued until the switch 31 is turned on when the ribbon guide member 25 reaches the moved position B in step S11. When the activation of the switch 31 is detected, step S12 is entered in which the motor 21 is stopped.

If a decision NO is given in step S7, step S9 is entered in which the display lamp 36 is lit to inform the operator that the ribbon guide member 25 is not in the initial position A. In accordance with an operating instruction 46 (FIG. 1) positioned in close vicinity to the display lamp 36, the operator removes the cassette 13 and manually slides the ribbon guide member 25 on the guide shaft 16 to the left until it reaches the initial position A. Then, in step S10, the printer is checked for the presence of the cassette 13. If the cassette 13 is found to be removed, step S9 is resumed in which the display lamp 36 is kept on. If the cassette 13 is found to be set in place in step S10, step S7 is resumed for the aforesaid judgment.

After the motor 21 is stopped in step S12, it starts to rotate reversely in step S13. The reverse rotation of the motor 21 is continued until the activation of the switch 32 is detected when the carriage 11 reaches the home position H in step S14. When the carriage 11 reaches the home position H, the motor 21 is stopped, so that the carriage 11 stops at the home position H in step S15.

Thus, a series of operations for the initialization of the printer is ended, and the printer is ready for printing.

After the printing operation is finished, the cassette 13 is removed in the following manner. First, the ribbon guide member 25 is pushed to the left of FIG. 1 with a suitable force. Thereupon, the resilient pieces 27 and 28 and the projection **27*a* are disengaged from the mating projection 29*a*, so that the ribbon 14 loosens to be removed from the member 25. Thereafter, the knob 24 of the cassette 13 is turned to take up and contract the ribbon portion 14*a*, and the cassette 13 is then removed. Thus, the cassette 13 can be smoothly removed without causing the ribbon 14** to catch or be soiled.

Although an illustrative embodiment of the present invention has been described in detail herein, the invention is not limited to the arrangement of the embodiment.

In the above embodiment, the printer has been described as including a thermal-type print head. Alternatively, however, the printer may be provided with a print element of a ball type or daisy wheel type.

In the above embodiment, moreover, the ribbon guide member is moved by the carriage. It may, however, be moved by any other suitable moving means.

What is claimed is:

1. A printer comprising:

a platen;

printing means movable relative to the platen along a print line on the platen;

ribbon supply means containing a print ribbon and disposed in a predetermined fixed position, said print ribbon including a looped ribbon portion exposed from the ribbon supply means to the outside;

a ribbon guide member movable along the print line between a first position and a second position, said ribbon guide member capable of being located within a region surrounded by the exposed looped ribbon portion when in the first position and to be releasably latched when in the second position;

moving means capable of actuating the ribbon guide member for movement between the first and second positions; and a control device including first sensing means for detecting the location of the ribbon guide member in the first position, second sensing means for detecting the location of the ribbon guide member in the second position, a control means for actuating, in cooperation with the first sensing means, the moving means so that the moving means urges the ribbon guide member in the first position to move toward the second position, thereby causing the ribbon guide member to engage the looped ribbon portion so that the ribbon is drawn out from the ribbon supply means, and said control means stopping, in cooperation with the second sensing means, the operation of the moving means when the ribbon guide member reaches the second position, thereby causing the ribbon to be stretched along the print line between the ribbon supply means and the ribbon guide member.

2. The printer according to claim 1, wherein said ribbon supply means includes a ribbon cassette removably mounted on a frame, and said control device includes third sensing means for detecting the attachment of the cassette.

3. The printer according to claim 1, wherein said control device further includes display means visually indicating, in cooperation with the first and second sensing means, when the ribbon guide member is neither in the first position nor in the second position.

4. The printer according to claim 1, wherein said printing means has a printing range of a predetermined length along the print line, said first position of the ribbon guide member being located close to one end of the printing range, and said second position beyond the other end of the printing range.

5. The printer according to claim 4, wherein said printing means is normally held in a home position within the printing range, and said control device includes fourth sensing means for detecting the location of the printing means in the home position.

6. The printer according to claim 5, wherein said home position of the printing means corresponds to said one end of the printing range.

7. The printer according to claim 6, further comprising a guide shaft extending parallel to the platen, wherein said printing means includes a carriage slidably supported on the guide shaft, and said ribbon guide member is slidably supported on the guide shaft so as to be moved from the first position to the second position by the moving means while engaging the carriage.

8. A printer comprising:

a platen;

printing means movable relative to the platen along a print line between a home position and a moved position for making a printing operation on the platen;

ribbon supply means containing a print ribbon and disposed in a fixed position, said print ribbon including a looped ribbon portion exposed from the ribbon supply means to the outside;

a guide rail extending parallel to the platen along the print line;

a ribbon guide member engaging the looped ribbon portion and said guide rail;

a guide shaft extending parallel to the platen along the print line and guiding said ribbon guide member for sliding movement on the guide shaft between an initial position and a predetermined position remote from the initial position;

latch means for releasably latching the ribbon guide member to said predetermined position;

sensing means for detecting the location of the ribbon guide member in the initial position;

control means for actuating, in cooperation with said sensing means, the movement of the printing means as an initial step of the printing operation from the home position toward the moved position so that the printing means contacts the ribbon guide member and moves the ribbon guide member from the initial position to said predetermined position, thereby automatically stretching the print ribbon along the print line; and said printing means being restored to said home position independently of the ribbon guide member latched in the predetermined position by said latch means.

9. The printer according to claim 8 wherein said ribbon guide member has a pair of resilient means in contact with the guide rail so as to nip the guide rail, thereby preventing the ribbon guide member from the rotating around the guide shaft.

10. The printer according to claim 9 wherein said latch means includes an engaging projection provided on one of the paired resilient means and a corresponding engaging projection provided on the lateral face of the guide rail facing said one resilient means.

11. The printer according to claim 8 wherein said ribbon supply means includes a ribbon cassette movably fixed on a frame and has a pair of ribbon exposing end portions, one of said end portions being located closer to the platen than the other end portion, thereby forming the looped ribbon portion between the pair of end portions.

* * * * *